US006120644A

United States Patent [19]

Schroeder et al.

[11] Patent Number: 6,120,644

[45] Date of Patent: Sep. 19, 2000

[54] TISSUE CONTAINING CATIONIC AMIDOAMINE COMPOUNDS

[75] Inventors: Wen Zyo Schroeder; Gary Lee Shanklin, both of Appleton, Wis.

[73] Assignee: Kimberly-Clark Worldwide, Inc., Neenah, Wis.

[21] Appl. No.: 09/211,635

[22] Filed: Dec. 15, 1998

Related U.S. Application Data

[62] Division of application No. 08/738,200, Oct. 25, 1996, Pat. No. 5,904,810.

[51] Int. Cl.[7] ..... D21H 21/22

[52] U.S. Cl. ..... 162/158; 162/111; 162/112; 162/135; 162/179; 162/184

[58] Field of Search ..... 162/11, 112, 113, 162/135, 158, 179, 184

[56] References Cited

U.S. PATENT DOCUMENTS

| | | | |
|---|---|---|---|
| 4,940,513 | 7/1990 | Spendel | 162/179 |
| 5,354,425 | 10/1994 | Makey et al. | 162/179 |
| 5,399,241 | 3/1995 | Oriaran et al. | 162/179 |
| 5,552,020 | 9/1996 | Smith et al. | 162/164.4 |
| 5,674,832 | 10/1997 | Keys | 510/504 |

FOREIGN PATENT DOCUMENTS

| | | | |
|---|---|---|---|
| 675225 | 10/1995 | European Pat. Off. | 162/158 |

*Primary Examiner*—Peter Chin
*Attorney, Agent, or Firm*—Gregory E. Croft

[57] ABSTRACT

The invention relates to tissue products having improved softness properties and methods of making them. Specifically, improved softness is achieved by incorporating a cationic amidoamine into the fiber furnish at the wet end of the tissue machine prior to formation and/or by topical addition to the tissue web. One or more softeners/debonders can be added to the furnish and/or topically applied to the tissue web after the tissue web is dried. The result is a tissue product with added bulk and a smooth surface feel, both properties contributing to improved softness characteristics.

6 Claims, No Drawings

TISSUE CONTAINING CATIONIC AMIDOAMINE COMPOUNDS

This application is a divisional of application Ser. No. 08/738,200 entitled TISSUE CONTAINING CATIONIC AMIDOAMINE COMPOUNDS and filed in the U.S. Patent and Trademark Office on Oct. 25, 1996 now U.S. Pat. No. 5,904,810. The entirety of application Ser. No. 08/738,200 is hereby incorporated by reference.

BACKGROUND OF THE INVENTION

Improving the softness of tissues is a continuing objective in tissue manufacture. In general, prior efforts have been directed at reducing the inter-fiber bonding within the tissue structure or coating the tissue surface with chemicals which improve the surface feel. Softness, however, is a perceived property of tissues comprising many factors including bulk softness and surface smoothness. To date, efforts have tended to focus on one or the other. Hence, there is a need for a method which improves both bulk softness and surface softness.

SUMMARY OF THE INVENTION

It has now been discovered that the softness of tissues can be improved by the addition of a cationic amidoamine compound (hereinafter defined) either to the tissue making furnish at the wet end of the tissue machine and/or to the formed web by topical addition. Optionally, one or more softener/debonders (hereinafter defined) can also be added to the furnish and/or can be added to the surface of the tissue web, wet or dry.

Hence in one aspect, the invention resides in a method for making soft tissue comprising: (a) forming an aqueous suspension of papermaking fibers containing a cationic amidoamine, with or without one or more softener/debonders; (b) forming a tissue web by depositing the aqueous suspension of papermaking fibers onto a forming fabric; and (c) dewatering and drying the web.

In another aspect, the invention resides in a method for making soft tissue comprising: (a) forming an aqueous suspension of papermaking fibers; (b) forming a tissue web by depositing the aqueous suspension of papermaking fibers onto a forming fabric; (c) dewatering and drying the web; and (d) topically applying a cationic amidoamine to the web.

In another aspect, the invention resides in a method for making soft tissue comprising: (a) forming an aqueous suspension of papermaking fibers and a cationic amidoamine; (b) forming a tissue web by depositing the aqueous suspension of papermaking fibers onto a forming fabric; (c) dewatering and drying the web; and (d) topically applying a cationic amidoamineto the web.

In all of the foregoing aspects, the amount of the cationic amidoamine in the aqueous suspension or added to the web can be from about 0.01 to about 10 weight percent, based on fiber, more specifically from about 0.1 to about 3 weight percent. In addition, one or more softener/debonders can be optionally added, either by inclusion in the aqueous suspension of papermaking fibers or by topical addition to the web. The softener/debonder applied to the web can be the same softener/debonder applied to the furnish, or it can be different if a softener/debonder is introduced at both locations.

In a further aspect, the invention resides in a soft tissue containing from about 0.01 to about 10 weight percent, based on dry fiber, more specifically from about 0.1 to about 3 weight percent, of a cationic amidoamine. Optionally, the tissue can further contain from about 0.1 to about 10 weight percent, based on dry fiber, of one or more softener/debonders described below.

As used herein, a cationic amidoamine compound is a cationic amidoamine containing a fatty acid moiety having one of the following structures:

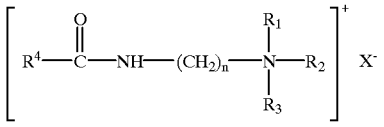

wherein $R_1$=hydrogen or $C_1$–$C_4$ alkyl;

$R_2$, $R_3$ can be the same or different, are $C_1$–$C_6$ alkyl or hydroxyalkyl; or

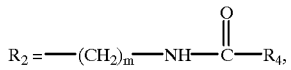

where m=2–6; and $R_4$=aliphatic $C_{12}$–$C_{24}$, saturated or unsaturated, normal or branched;

n=2–6; and

X=halide, methyl sulfate, ethyl sulfate, or other compatible counterion; or

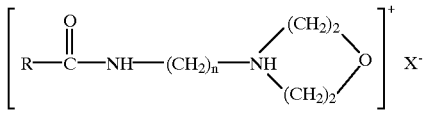

wherein R=aliphatic $C_{12}$–$C_{24}$, saturated or unsaturated, normal or branched;

n=2–6; and

X=halide, methyl sulfate, ethyl sulfate, or other compatible counterion.

Specific cationic amidoamines include isostearamido propyl morpholine lactate and isostearamido propyl dimethylamine lactate.

As used herein, "softener/debonder" is a chemical compound selected from the group consisting of quaternary ammonium compounds, bis-imidazolinium compounds, di-quaternary ammonium compounds, polyammonium compounds, quaternized protein compounds, phospholipids, silicone quaternaries, silicone betaines, quaternized, hydrolyzed wheat protein/dimethicone phosphocopolyol copolymer, organoreactive polysiloxanes, and silicone glycols.

Suitable quaternary ammonium compounds have the following structures:

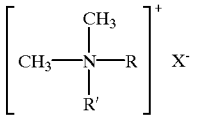

wherein X=chloride, methyl sulfate, or other compatible counterion; and

R', R=can be the same or different, are aliphatic, saturated or unsaturated, normal or branched, $C_8$–$C_{24}$; or

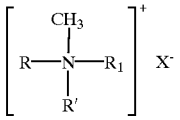

wherein X=chloride, methyl sulfate, or other compatible counterion;

R', R=can be the same or different, are aliphatic, saturated or unsaturated $C_8$–$C_{24}$; and $R_1$=benzyl or epoxy group; or

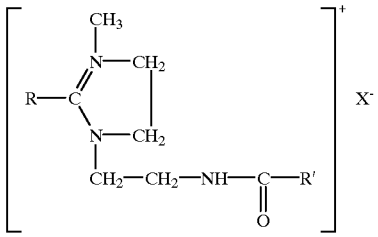

wherein X=chloride, methyl sulfate, or other compatible counterion; and

R, R' can be the same or different, are aliphatic, saturated or unsaturated, normal or branched, $C_8$–$C_{24}$; or

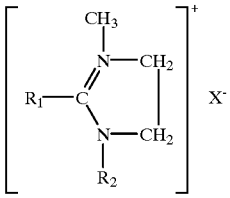

wherein X=chloride, methyl sulfate or other compatible counterion;

$R_1$=aliphatic, saturated or unsaturated, branched or normal, $C_8$–$C_{24}$; and

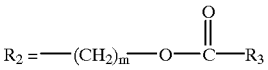

m=1–6

$R_3$=aliphatic, saturated or unsaturated, branched or normal, $C_8$–$C_{24}$; or

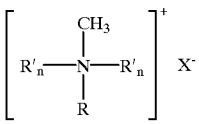

wherein R=aliphatic, normal or branched, saturated or unsaturated, $C_8$–$C_{24}$;

X=chloride, methyl sulfate, ethyl sulfate, or other compatible counterion;

R'=2-hydroxyethyl or polyethoxyethanol; and n=1 to 50; or

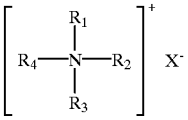

wherein $R_1$, $R_2$, $R_3$ are $C_1$–$C_6$ alkyl or hydroxyalkyl, can be the same or different

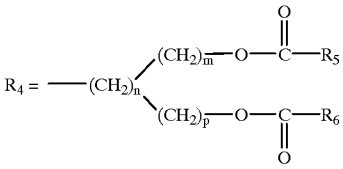

n=2–6;

m=0–6;

p=1–6;

$R_5$, $R_6$ are $C_8$–$C_{24}$ aliphatic, normal or branched, saturated or unsaturated, (same or different); and X=chloride, methyl sulfate, ethyl sulfate, or other compatible counterion; or

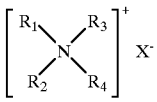

wherein X=chloride, methyl sulfate, ethylsulfate, or other compatible counterion;

$R_1$, $R_2$ can be the same or different, are $C_1$–$C_6$ alkyl or hydroxyalkyl;

$R_3$, $R_4$ can be the same or different selected from the structure:

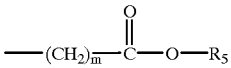

where m=1–6; and $R_5$=aliphatic, $C_8$–$C_{24}$, saturated or unsaturated; or

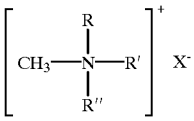

wherein R, R', R"=can be the same or different, are aliphatic alkyl, normal or branched, saturated or unsaturated, $C_5$–$C_{24}$; and X=chloride, methyl sulfate or other compatible counterion; or

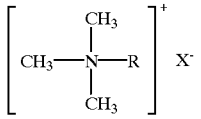

wherein R=aliphatic, saturated or unsaturated, $C_8$–$C_{24}$; or allyl-; or

R'—O—$(CH_2)_m$—where R'=normal or branched, saturated or unsaturated, $C_4$–$C_{18}$;

m=1–4; and

X=chloride, sulfate or any other compatible counterion.

Suitable quaternized protein compounds include the following structures:

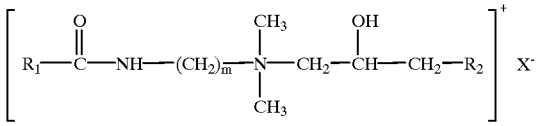

wherein $R_1$=fatty acid radical, saturated or unsaturated, branched or unbranched $C_{12}$–$C_{24}$;

$R_2$=hydrolyzed soy protein, hydrolyzed silk protein, collagen, keratin moiety or hydrolyzed wheat protein;

m=1–6; and

X=chloride, lactate or other compatible counterion; or

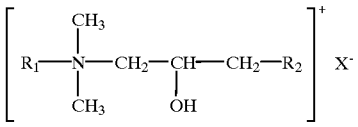

wherein $R_1$=fatty acid radical, saturated or unsaturated, $C_{12}$–$C_{24}$;

$R_2$=hydrolyzed collagen or keratin moiety; and

X=chloride, lactate or other compatible counterion.

R, $R_1$ & $R_2$ can be the same or different, are alkyl, substituted alkyl, alkyl aryl or alkenyl groups of up to 16 carbon atoms and the total carbon atoms of $R+R_1+R_2$=10 to 24; or

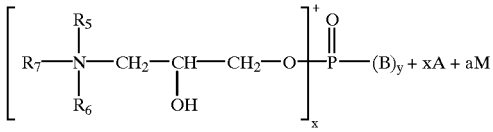

wherein x=1 to 3;

x+y=3;

a=0 to 2;

B=$O^-$ or OM;

A=an anion;

M=a cation;

$R_5$, $R_6$ may be the same or different, are alkyl, hydroxyalkyl, carboxyalkyl of up to $C_6$, or polyoxyalkylene of up to $C_{10}$; or $R_5$, $R_6$ and the nitrogen they are attached to may represent an N-heterocycle; and $R_7$=an amidoamine moiety of the formula:

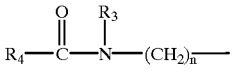

wherein n=2 to 6;

$R_3$=hydrogen or alkyl, hydroxyalkyl or alkenyl of up to 6 carbons or cycloalkyl of up to 6 carbon atoms, or polyoxyalkylene of up to 10 carbon atoms; and $R_4$=alkyl, alkenyl, alkoxy or hydroxyalkyl, $C_5$–$C_{21}$, or aryl or alkaryl of up to $C_{20}$; or

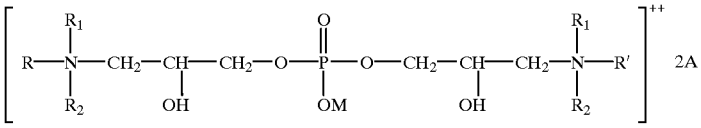

Suitable phospholipids include, without limitation, those having the following structures:

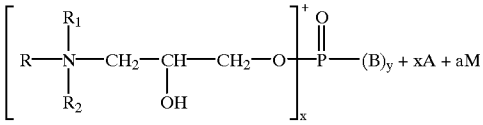

wherein x=1 to 3;

x+y=3;

a=0 to 2:

B=O or OM;

A=an anion;

M=a cation; and wherein A=an anion;

M=a cation;

R, $R_1$ & $R_2$ can be the same or different, are alkyl, substituted alkyl, alkyl aryl or alkenyl groups of up to 16 carbon atoms, and the total carbon atoms of R + $R_1+R_2$=10 to 24; and R' is an amidoamine moiety of the structure:

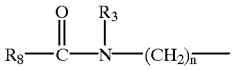

wherein n=2 to 6;

$R_3$=hydrogen or alkyl, hydroxyalkyl or alkenyl of up to 6 carbons;

or cycloalkyl of up to 6 carbon atoms, or polyoxyalkylene of up to 10 carbon atoms; and $R_8$ has the following structure:

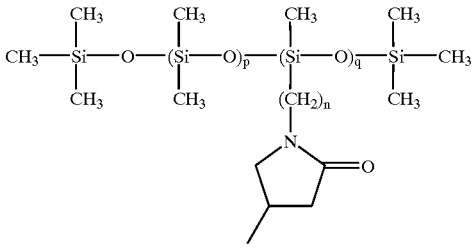

wherein n=3 or greater;

p=1 to 1000;

q=1 to 25.

Suitable silicone quaternaries include the following structure:

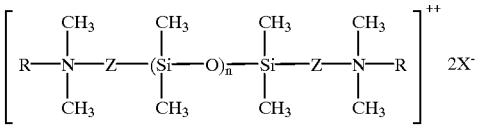

wherein R=alkyl group, $C_{12}$–$C_{24}$;

Z=—$CH_2$—$CH_2$—$CH_2$—O—$(CH_2)_3$—;

X=alkoxy, chloride or other compatible counterion; and n=1 to 50; or

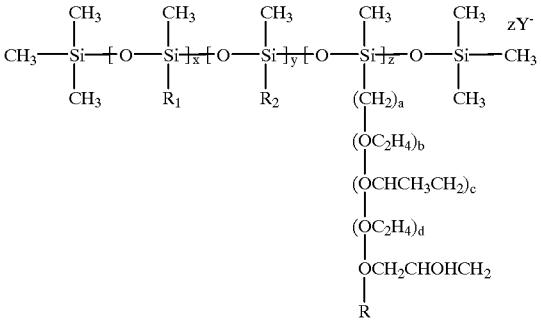

wherein:

x=0–1000;

y, z=1–1000;

$R_1$, $R_2$ can be the same or different, are alkyl or hydroxyalkyl, $C_1$–$C_{20}$ or phenyl;

a=1–4;

b, c, d=0–20;

Y=halide, methyl sulfate, ethyl sulfate or other compatible counterion; and

R can be selected from among the following four groups:

(1)

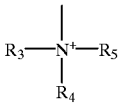

where $R_3$, $R_4$, $R_5$ can be the same or different, are selected from hydroxyalkyl or alkyl group, $C_1$–$C_4$, or aliphatic group, $C_8$–$C_{24}$, normal or branched, saturated or unsaturated;

(2)

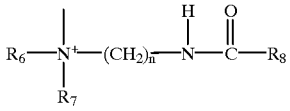

where $R_6$, $R_7$, $R_8$ can be the same or different, are selected from aliphatic group, $C_8$–$C_{24}$, normal or branched, saturated or unsaturated; and n=1–6;

or where $R_6$, $R_7$ can be the same or different, are alkyl or hydroxyalkyl, $C_1$–$C_6$;

$R_8$=aliphatic, $C_8$–$C_{24}$, normal or branched, saturated or unsaturated; and n=1–6;

or where $R_6$=hydroxyalkyl or alkyl, $C_1$–$C_6$;

n=1–6;

$R_7$=

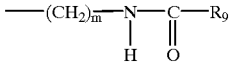

m=1–6; and $R_9$, $R_8$=aliphatic, $C_8$–$C_{24}$, normal or branched, saturated or unsaturated;

or where $R_6$=hydroxyalkyl or alkyl, $C_1$–$C_6$;

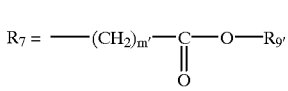

m'=1–6; and $R_8$, $R_9$ can be the same or different, are aliphatic, $C_8$–$C_{24}$, normal or branched, saturated or unsaturated;

(3)

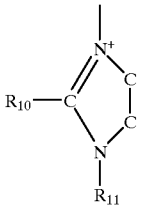

where $R_{10}$, $R_{11}$ can be the same or different, are aliphatic $C_8$–$C_{24}$, normal or branched, saturated or unsaturated, or

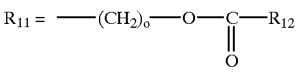

where o=1–6; and $R_{12}$=aliphatic, $C_8$–$C_{24}$, normal or branched, saturated or unsaturated;

(4)

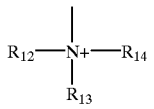

where $R_{12}$, $R_{13}$=$C_1$–$C_6$, alkyl or hydroxyalkyl;

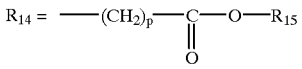

p=1–6; and $R_{15}$=aliphatic, $C_8$–$C_{24}$, normal or branched, saturated or unsaturated;

or $R_{12}$=$C_1$–$C_6$ alkyl or hydroxyalkyl;

$R_{13}$, $R_{14}$ can be the same or different, are

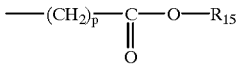

p=1–6; and $R_{15}$=aliphatic, $C_8$–$C_{24}$, normal or branched, saturated or unsaturated;

or $R_{12}$, $R_{13}$ can be the same or different, are $C_1$–$C_6$ alkyl or hydroxyalkyl

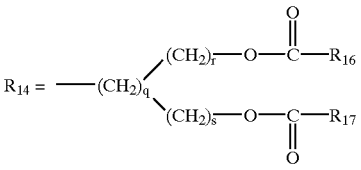

q=1–6;

r, s=0–6; and $R_{16}$, $R_{17}$ can be the same or different, are $C_8$–$C_{24}$ aliphatic, normal or branched, saturated or unsaturated.

Suitable organoreactive polysiloxanes include the following structures:

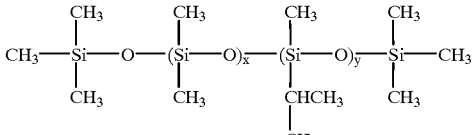

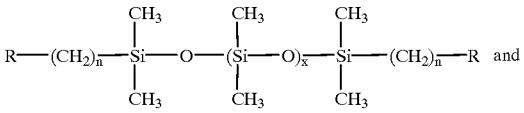

and

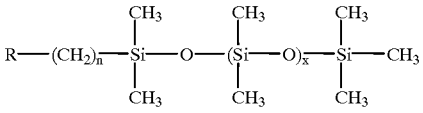

wherein R=amine, carboxy, hydroxy, or epoxy;

n=3 or greater;

x=1 to 1000; and y=1 to 25.

Suitable silicone betaines include the following structure:

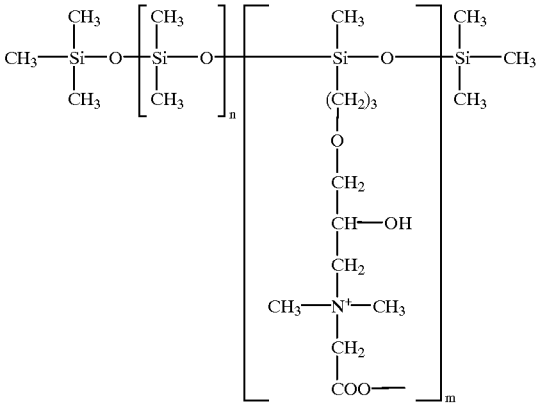

wherein m=1–100; and n=1–1000.

Suitable silicone glycols include the following structure:

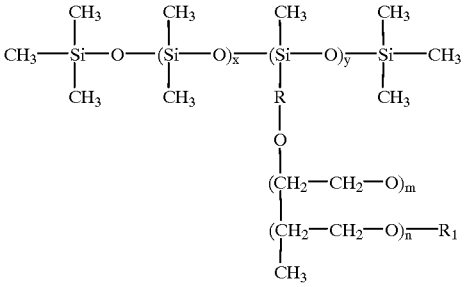

wherein R=alkyl group, $C_1$–$C_6$;

$R_1$=acetate or hydroxy group;

x=1 to 1000;

y=1 to 50;

m=1 to 30; and n=1 to 30.

Suitable bis-imidazolinium compounds include the following structures:

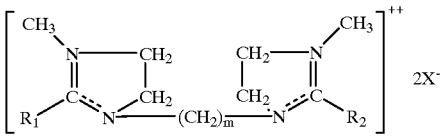

wherein X=halide, methylsulfate, ethylsulfate or other compatible counterions;

m=2–8;

$R_1$, $R_2$ may be the same or different, are aliphatic, $C_{12}$–$C_{24}$, normal or branched, saturated or unsaturated.

Suitable diquaternary ammonium compounds include the following structures:

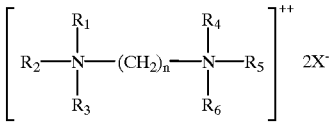

wherein X=halide, methylsulfate, ethylsulfate or other compatible counterion;

n=2–8;

$R_1$, $R_4$ may be the same or different, are H, $CH_3$, or $(CH_2)_mOH$;

m=1–4;

$R_2$, $R_3$, $R_5$, $R_6$ may be the same or different, are from the following groups:

$(CH_2)_p$ OH, where p=1–6;

or

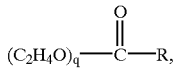

where q=1–10, R=aliphatic, $C_{12}$–$C_{24}$, saturated or unsaturated, normal or branched;

or

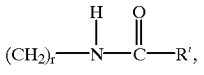

where r=1–10, R'=aliphatic, $C_{12}$–$C_{24}$, saturated or unsaturated, normal or branched;

or

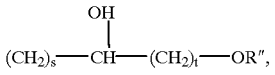

where s=1–10, t=1–4, R"=aliphatic, $C_{12}$–$C_{24}$, saturated or unsaturated, normal or branched.

Suitable poly ammonium compounds include the following structures:

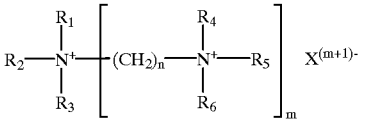

wherein n=2–6;

m≧1;

X=halide, methyl sulfate, ethyl sulfate or other compatible counterion;

$R_1$, $R_4$, $R_3$, $R_6$ may be the same or different, are H, $CH_3$, or $(CH_2)_p$ OH where p=2–6, or aliphatic, $C_{12}$–$C_{24}$, normal or branched, saturated or unsaturated;

$R_2$, $R_5$ may be the same or different, are aliphatic, $C_{12}$–$C_{24}$, normal or branched, saturated or unsaturated, or $(CH_2)_q$ —CHOH—R' where R'=$C_{12}$–$C_{24}$, normal or branched, saturated or unsaturated, and q=1–6; or $(CH_2)_r$—O—R" where r=1–6, R"=$C_{12}$–$C_{24}$, normal or branched, saturated or unsaturated.

When a combination of cationic amidoamine and softener/debonder is desired, the combination can be added to the thick stock simultaneously or separately. The combinations can contain one or more compounds from the above groups and added to the slurry, either in a premixed form or individually metered.

The amount of cationic amidoamine added to the furnish or the formed tissue web can be from about 0.01 to about 10 percent (by weight of the fiber). More preferably, the amount can be from about 0.1 to about 3 weight percent.

Softener/debonders used for the topical treatment can be delivered in an aqueous solution or be dissolved in a suitable solvent such as propylene glycol, ethylene glycol, hexylene glycol, polyethylene glycol, isopropyl alcohol, methanol, ethanol or other organic solvents. They can be applied to the surface of the basesheet individually or in combination with others. It is preferred that the composition for topical treatment comprises from about 1 to about 100 weight percent of the softener/debonder (individually or in combination with other amidoamines or softener/debonders), more preferably from about 35 to about 80 weight percent. It is also preferred that the softener/debonder be topically added to the tissue sheet at an add-on ratio of from about 0.01 to about 10 weight percent of the fiber, and more preferably from about 0.1 to about 2 weight percent of the fiber.

Suitable methods for the topical treatment include, but are not limited to spraying, rotogravure printing, trailing blade coating, flexographic printing, and the like.

EXAMPLES

Example 1

A 1-ply, blended, uncreped, through-air-dried basesheet was made. The furnish contained 50 weight percent of bleached eucalpytus hardwood kraft pulp and 50 weight percent of bleached northern softwood kraft pulp. The thick stock was diluted to approximately 0.01 percent consistency prior to forming, dewatering and drying of the tissue web. The fan pump was set at about 21 psi, while the wet draw was set at about −25%. The total basis weight of the sheet was 16 lb per 2880 square feet with a target machine direction stretch of 20%.

Isostearamidopropyl morpholine lactate (Macklene 426, McIntyre Group, LTD.) was added to the thick stock at 2 and 4 kilograms of debonder per metric ton of fiber and 0.2 and 0.4 weight percent, respectively). The resulting tissue product was softer than the untreated control with improved surface smoothness.

Example 2

Isostearamidopropyl dimethylamine lactate (Macklene 416, McIntyre Group, LTD.) was added to the thick stock (same furnish as in Example 1) at the same levels as in Example 1. The resulting tissue product was softer than the untreated control with improved surface smoothness.

Example 3

An aqueous mixture containing 8 weight percent of Macklene 426 (McIntyre Group, LTD.) and 10 weight percent of C-6027 (Imidazoline-based quaternary ammonium compound, Witco Corporation) was added to the thick stock (same furnish as in Example 1) at the same levels as in Example 1. The resulting tissue product was much softer than the untreated control with improved surface smoothness.

Example 4

An aqueous mixture containing 20 weight percent of Macklene 416 (McIntyre Group, LTD.) and 6.25 weight percent of C-6027 (Imidazoline-based quaternary ammonium compound, Witco Corporation) was added to the thick stock (same furnish as in Example 1) at the same levels as in Example 1. The resulting tissue product was softer than the untreated control with improved surface smoothness.

Example 5

A 2-ply, wet-pressed, creped tissue was made using a layered headbox. The first stock layer (the layer which ultimately contacts the Yankee dryer surface) contained eucalpytus hardwood fiber and provided about 60 dry weight percent of the tissue sheet. The remaining 40 percent of the tissue sheet was provided via a second stock layer consisting of northern softwood kraft pulp. The total basis weight of the sheet was about 7.3 pounds per 2880 square feet of air dried tissue. Two strength agents were added to the fiber stock layers prior to the headbox. Parez 631 NC (a glyoxalated polyacrylamide from Cytec Industries, Inc.) was metered into the softwood thick stock at 0.08 to 0.1 percent of the total fiber weight. Another strength agent, Kymene 557 LX (commercially available from Hercules, Inc.) was metered into both the hardwood and the softwood thick stock at 0.05 and 0.1 percent of the total fiber weight, respectively.

After drying and creping, the tissue sheet was plied together with a like sheet to form a two-ply, crimped tissue with the eucalyptus fibers facing the outside. Mackalene 426 (McIntyre Group, LTD., 25% active) was rotogravure-printed onto both plies of the hardwood layer at an add-on amount of approximately 1 percent per ply based on the weight of fiber. The resulting tissue product had improved surface smoothness.

It will be appreciated that the foregoing examples, given for purposes of illustration, are not to be construed as limiting the scope of this invention, which is defined by the following claims and all equivalents thereto.

What is claimed is:

1. A soft tissue comprising from about 0.01 to about 10 weight percent of a cationic amidoamine having the following structure:

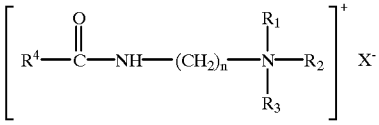

where $R_1$=hydrogen or $C_1$–$C_4$ alkyl;

$R_2$=$C_1$–$C_6$ alkyl, hydroxyalkyl; or

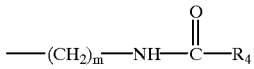

$R_3$=$C_1$–$C_6$ alkyl or hydroxyalkyl;

m=2–6;

$R_4$=aliphatic $C_{12}$–$C_{24}$, normal or branched, saturated or unsaturated;

n=2–6; and

X=halide, methyl sulfate, ethyl sulfate or other compatible counterion.

2. A soft tissue comprising from about 0.01 to about 10 weight percent of a cationic amidoamine having the following structure:

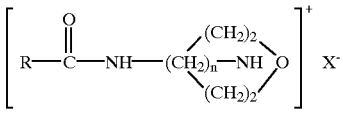

where R=aliphatic $C_{12}$–$C_{24}$, saturated or unsaturated;

n=2–6; and

X=halide, methyl sulfate, ethyl sulfate or other compatible counterion.

3. The tissue of claim 2 wherein the cationic amidoamine is isostearamidopropyl morpholine lactate.

4. The tissue of claim 1 wherein the cationic amidoamine is isostearamidopropyl dimethylamine lactate.

5. The tissue of claim 1 or 2 wherein the amount of cationic amidoamine is from about 0.1 to about 3 weight percent, based on dry fiber.

6. The tissue of claim 1 or 2 further comprising from about 0.1 to about 10 weight percent, based on dry fiber, of a softener/debonder.

* * * * *